US008459510B2

(12) United States Patent
Richards et al.

(10) Patent No.: US 8,459,510 B2
(45) Date of Patent: Jun. 11, 2013

(54) DISPENSER ASSEMBLY

(75) Inventors: James L. Richards, Dassel, MN (US); Loren L. Brelje, Glencoe, MN (US)

(73) Assignee: David S. Smith America, Inc., Lester Prairie, MN (US)

( * ) Notice: Subject to any disclaimer, the term of this patent is extended or adjusted under 35 U.S.C. 154(b) by 238 days.

(21) Appl. No.: 12/839,860

(22) Filed: Jul. 20, 2010

(65) Prior Publication Data

US 2012/0018459 A1 Jan. 26, 2012

(51) Int. Cl.
*B67D 3/00* (2006.01)

(52) U.S. Cl.
USPC ..... 222/484; 222/188

(58) Field of Classification Search
CPC ..... B67D 3/00; B65D 45/06; B65D 83/05
USPC ..... 222/482–484, 188, 470–473
See application file for complete search history.

(56) References Cited

U.S. PATENT DOCUMENTS

| | | | | | |
|---|---|---|---|---|---|
| 1,092,101 | A | * | 3/1914 | Hansen | 222/473 |
| 2,197,352 | A | | 4/1940 | Terkel | |
| 2,842,291 | A | | 7/1958 | Duval et al. | |
| 3,059,816 | A | * | 10/1962 | Goldstein | 222/109 |
| 3,655,102 | A | * | 4/1972 | Moran | 222/484 |
| 3,739,938 | A | * | 6/1973 | Paz | 220/715 |
| 3,913,611 | A | | 10/1975 | St. John | |
| 3,972,443 | A | | 8/1976 | Albert | |
| 4,133,446 | A | | 1/1979 | Albert | |
| 4,487,342 | A | | 12/1984 | Shy | |
| 4,687,122 | A | * | 8/1987 | Bothun et al. | 222/183 |
| 4,815,616 | A | * | 3/1989 | Silvenis | 215/232 |
| 4,844,290 | A | * | 7/1989 | McCurdy et al. | 222/185.1 |
| 4,893,651 | A | | 1/1990 | Herman et al. | |
| 4,930,689 | A | | 6/1990 | Stumpf | |
| 4,942,976 | A | | 7/1990 | Spencer | |
| 5,037,015 | A | * | 8/1991 | Collins | 222/472 |
| 5,115,949 | A | * | 5/1992 | Rosenthal | 222/211 |
| 5,485,938 | A | | 1/1996 | Boersma | |
| 5,947,343 | A | * | 9/1999 | Horstmann | 222/474 |
| 6,364,178 | B1 | | 4/2002 | Paczonay | |
| 6,401,752 | B1 | | 6/2002 | Blackbourn et al. | |
| 6,427,880 | B1 | * | 8/2002 | Hirose et al. | 222/517 |
| 6,446,845 | B1 | | 9/2002 | Steiger | |
| 6,763,964 | B1 | | 7/2004 | Hurlbut et al. | |
| 7,195,137 | B2 | | 3/2007 | Belcastro | |

(Continued)

FOREIGN PATENT DOCUMENTS

NL 1003708 C2 7/1996

*Primary Examiner* — Lien Ngo
(74) *Attorney, Agent, or Firm* — Vidas, Arrett & Steinkraus, P.A.

(57) ABSTRACT

In some embodiments, a dispenser for attachment to a liquid container may include one or more of the following features: (a) a tubular valve body of a generally hollow form having a liquid outlet port on one end of the valve body capable of coupling to the liquid container, the valve body further including an air vent opening and a liquid vent opening located on an opposite side of the valve body, (b) an integral lid with the valve body slidingly disposed on the opposite side of the valve body and coupled to be moved between a liquid blocking and a liquid dispensing position, and (c) a liquid seal coupled to the integral lid capable of positioning within a liquid vent opening and an air seal coupled to the integral lid capable of positioning within an air vent opening.

20 Claims, 7 Drawing Sheets

U.S. PATENT DOCUMENTS 7,513,395 B2 4/2009 Labinski et al.
7,735,698 B2 * 6/2010 Lin ..... 222/472
8,113,239 B2 * 2/2012 Richards et al. ..... 137/588
2009/0090745 A1 4/2009 Forbis

* cited by examiner

DISPENSER ASSEMBLY

I. FIELD OF THE INVENTION

Embodiments of the present invention generally relate to dispensing liquids.

Particularly, embodiments of the present invention relate to dispensing valves for liquid containers. More particularly embodiments of the present invention relate to a dispensing valve incorporating an air vent whereby pressure within the container is equalized as the liquid contents are dispensed.

II. BACKGROUND

A variety of push-button actuated dispensing valves for dispensing liquids from a relatively large capacity container are known in the art. Where the dispensing valve or tap is used with a flexible wall container, it is not necessary for the container to be vented in any way because no pressure differential is created upon the emptying of the container through the tap.

However, with a rigid container, a system must be provided for equalizing the pressure differential created as contents of the rigid wall container are extracted. Such a vent may be remote from the dispensing valve and may merely comprise a capped opening in an upper wall of the container which, when uncapped, permits ingress of air into the container volume as the liquid contents of the container are being dispensed. Also known in the prior art are self-venting valves eliminating the need for a separate, remote vent opening in the container. Those with knowledge of the dispensing art will recognize with the discussion below how embodiments of the present invention not only differ, but how embodiments of the present invention provide for a much more functional liquid dispenser.

It would be desirable to have a low cost, easy to assemble, reliably operating, mess-free dispensing valve for a rigid container, which will work well with both viscous and low viscosity liquids. It is also desirable to have a dispensing valve which provides an automatic shut off function to prevent inadvertent dispensing. It is desirable to provide a liquid dispenser which does not require a separate input for air on the container, which requires more manufacturing costs.

III. SUMMARY OF THE INVENTION

In some embodiments, a dispenser for attachment to a liquid container may include one or more of the following features: (a) a tubular valve body of a generally hollow form having a liquid outlet port on one end of the valve body capable of coupling to the liquid container, the valve body further including an air vent opening and a liquid vent opening located on an opposite side of the valve body, (b) an integral lid with the valve body slidingly disposed on the opposite side of the valve body and coupled to be moved between a liquid blocking and a liquid dispensing position, (c) a liquid seal coupled to the integral lid capable of positioning within a liquid vent opening and an air seal coupled to the integral lid capable of positioning within an air vent opening, (d) a collapsible dome member coupled to the opposite side of the valve body adjacent to the integral lid and movable between a compressed and an expanded state, (e) an elongated, generally rigid stem member having a first end coupled to the collapsible and a second end capable of flexibly extending within the valve body; the collapsible member capable of being compressed when an operator presses upon the lid and expanding when released by the operator, and (f) a seal sheet located between the outlet port and the opposite side of the valve body.

In some embodiments, a dispenser may include one or more of the following features: (a) a generally cylindrical valve body having a liquid inlet end, said liquid inlet end capable of coupling to an opening on a liquid container, an opposite end having a liquid outlet port, the valve body further including an air vent opening located on the opposite end of the valve body, (b) an integral lid with the valve body slidingly disposed on the opposite side of the valve body and coupled to be moved between a liquid blocking and a liquid dispensing position, (c) a liquid seal coupled to the integral lid capable of positioning within a liquid vent opening and an air seal coupled to the integral lid capable of positioning within an air vent opening, (d) a flaring chute proximate the liquid vent, and (e) a nozzle located adjacent to the liquid vent.

In some embodiments, a dispenser may include one or more of the following features: (a) a tubular valve body having a liquid outlet port on one end of the valve body capable of coupling to a liquid container, the valve body further including an air vent opening and a liquid vent opening located on an opposite side of the valve body, (b) a lid operably coupled with the valve body, the lid slidingly disposed on the opposite side of the valve body and coupled to be moved between a liquid blocking and a liquid dispensing position, (c) a liquid seal coupled to the integral lid capable of positioning within a liquid vent opening and an air seal coupled to the integral lid capable of positioning within an air vent opening, (d) a collapsible dome member coupled to the opposite side of the valve body adjacent to the lid and movable between a compressed and an expanded state, (e) an elongated, generally rigid stem member having a first end coupled to the collapsible dome member and a second end capable of flexibly extending within the valve body, (f) a flange member located adjacent to a liquid vent opening, and (g) a seal sheet located between the outlet port and the opposite side of the valve body.

IV. DESCRIPTION OF THE DRAWINGS

V. DESCRIPTION OF THE PREFERRED EMBODIMENT

Figure 1:
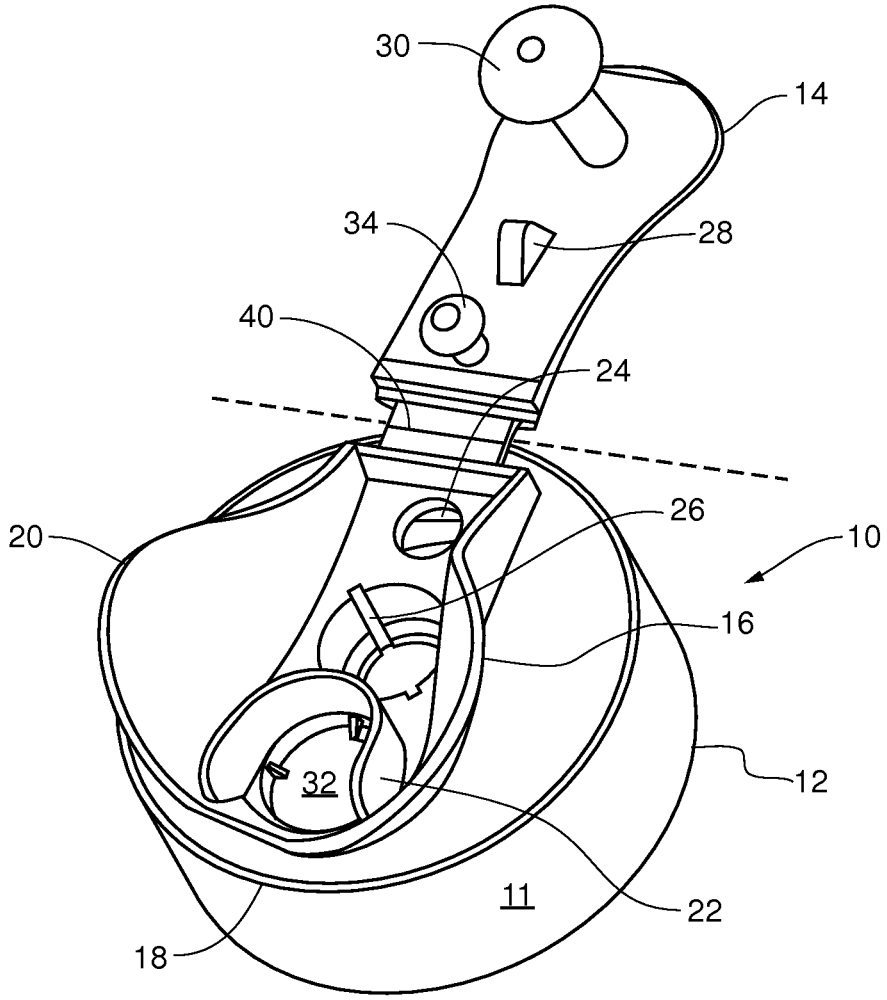
FIG. 1 is an isometric view of a dispenser assembly in an open position in an embodiment of the present invention.

The following discussion is presented to enable a person skilled in the art to make and use the present teachings. Various modifications to the illustrated embodiments will be readily apparent to those skilled in the art, and the generic principles herein may be applied to other embodiments and applications without departing from the present teachings. Thus, the present teachings are not intended to be limited to embodiments shown, but are to be accorded the widest scope consistent with the principles and features disclosed herein. The following detailed description is to be read with reference to the figures, in which like elements in different figures have like reference numerals. The figures, which are not necessarily to scale, depict selected embodiments and are not intended to limit the scope of the present teachings. Skilled artisans will recognize the examples provided herein have many useful alternatives and fall within the scope of the present teachings. While the present invention is discussed in relation to dispensing a low viscosity fluid, such as water, it is fully contemplated the present invention could be extended to any fluid regardless of the viscosity, such as water, oil, orange juice or laundry detergent, without departing from the spirit of the invention.

Embodiments of the present invention broadly disclose a dispenser which may be a cap or piece to be molded onto a container for dispensing liquids. This type of dispenser can be of the vented valve type, so the dispenser has one opening to allow air to flow into the container and a second opening to allow liquid to exit the container. Allowing air to flow into the container can create substantially equal pressure on the inside and the outside of the container so a vacuum effect is not created.

Some vented valves have one opening which allows air to simultaneously flow into the container while allowing liquid to flow out. Other vented valves have multiple openings so at least one opening allows liquid to flow out while at least one other opening allows air to pass into the container. Most of the time, in a multiple opening vented valve, a cover closes the openings so liquid is not able to exit the container unless the cover is removed.

Embodiments of the present invention disclose a vented valve dispenser for a container. Embodiments of the present invention disclose a closure which is within a first larger opening. In line with the first opening is a second smaller opening. The second smaller opening has a closure piece which fits within the second smaller opening. The first larger opening allows liquid to flow out of the container; while the second smaller opening allows air to enter into the container.

As discussed in embodiments of the present invention, the first and second closures are disposed on a lever. This lever is attached to the outside of the dispenser so the wider ends of the closure pieces are within the container. The size of the closure can ensure the ends do not come out of the dispenser. When the dispenser is in a closed position, the ends of the closure pieces seal the dispenser and the container is closed so no liquid can exit and no air can enter. When a user desires to open the dispenser, the user engages the lever by pressing inward towards the container. The closure pieces are moved away from the openings and into the container; so liquid exits the container by flowing outwardly and around the larger closure piece and air enters into the container by flowing around the smaller closure piece. The lever may be coupled to the dispenser in any means so it is held in a closed position and only opens when a force is applied against it.

With reference to FIG. 1, an isometric view of a dispenser assembly in an embodiment of the present invention is shown. Dispenser 10 can be comprised of main body 12 and lid 14. Main body can have a lid housing mechanism 16 at a top 18 of body 12. Body 12 can have most any thickness as defined by base 11, but can be designed to be integral with or separate from most any liquid container. Housing mechanism 16 can commonly have a flaring chute 20 which allows any fluid to effectively pour without spilling. Also a part of body 12 is nozzle 22, which allows for the fluid to flow. Air port 24 allows for air to enter during the liquid disposition process. Stem 26 is commonly covered by a protective covering (not shown), which provides a barrier between stem 26 and actuator 28. Liquid seal 30 on lid 14 acts to seal nozzle opening 32 when lid 14 is shut upon body 12 (discussed in greater detail below). Further, air seal 34 acts to seal air port 24 when lid 14 is shut upon body 12 by rotating along axis 40.

It is noted body 12 and lid 14 can be integral and require no coupling with a main body. Whether body 12 is integral with a liquid dispenser or not, lid 14 could be shut thus closing nozzle opening 32.

Figure 2:
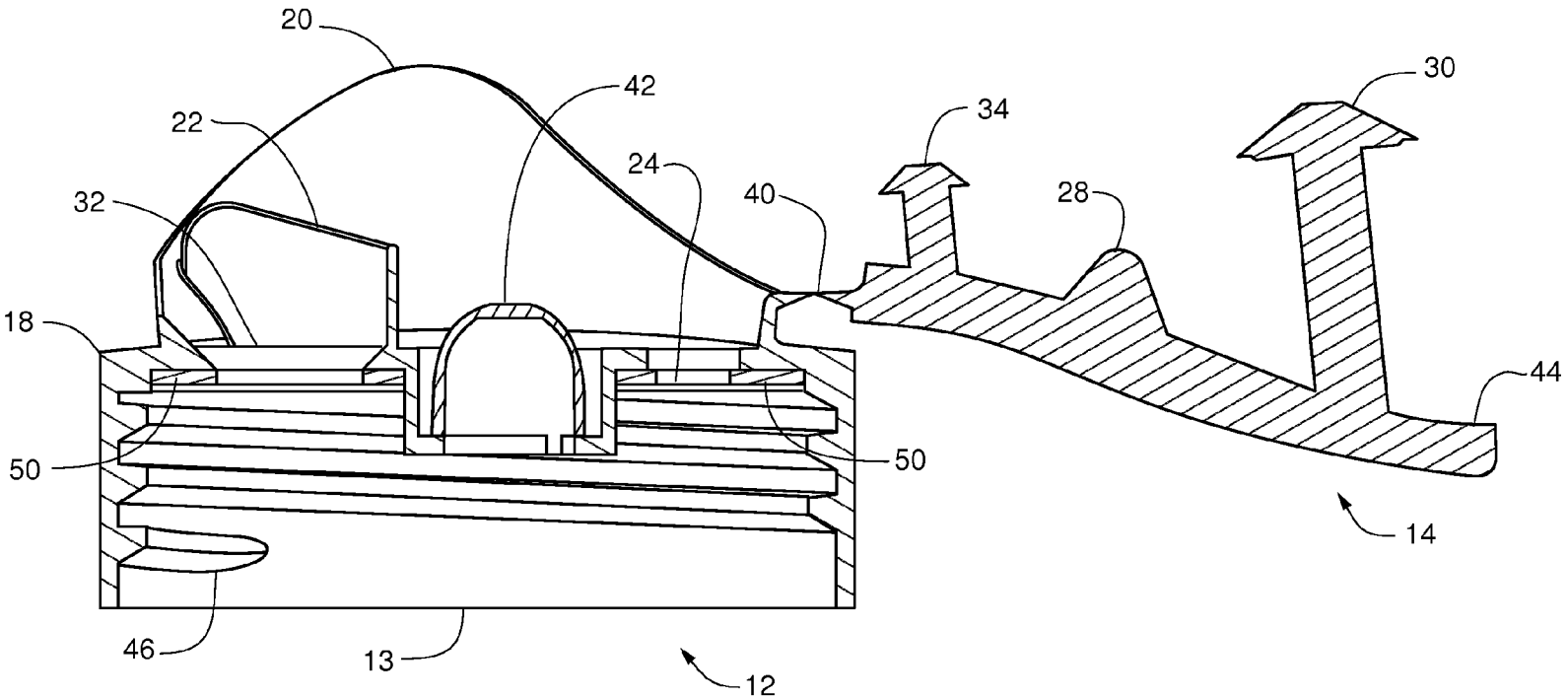
FIG. 2 is a side cutaway view of a dispenser assembly in an open position in an embodiment of the present invention.

With reference to FIG. 2, a side cutaway view of a dispenser assembly in an embodiment of the present invention is shown. In this embodiment, a bulb 42, which protects stem 26 and when pressed upon by actuator 28 can cause bulb 42 to depress thus moving stem 26 downwards (discussed in greater detail below). Bulb 42 could be made of a TPE (thermoplastic elastomer) and body 12 of polypropylene, but most any materials could be used without departing from the spirit of the invention. Body 12 can have threads 46 for rotation onto a liquid dispenser body; however, body 12 can be integral with a liquid dispenser. Further, most any mode of connection of body 12 to a liquid dispenser is contemplated without departing from the invention. Further, it is contemplated body 12 could have most any connection mechanism with a liquid dispenser without departing from the spirit of the invention. Additionally, body 12 can have a seal sheet 50 which acts to seal a liquid from liquid seal 30 and air or liquid from air seal 34. Seal sheet 50 can be made from TPE to create a soft formed seal when stem 26 presses against bulb 42 and thus actuator 28 to keep lid 14 extended outward and thus a liquid would not be able to be dispensed. Axis 40 shows the link between lid 14 and body 12 creating an integral assembly 10. An operation area 44 on lid 14 can allow an operator to press upon lid 14; however, it is fully contemplated the operator could press upon most any portion of lid 14 to depress lid 14 within body 12. Furthermore, it is noted opening 13 provides the channel from which fluid will travel from a liquid container to and through dispenser 10.

Figure 3A:
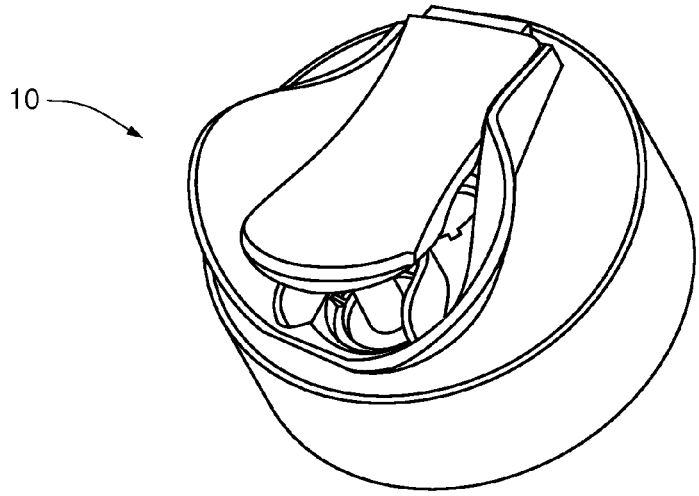
FIG. 3A is an upper elevated view of a dispenser assembly in a closed position in an embodiment of the present invention.
Figure 3B:
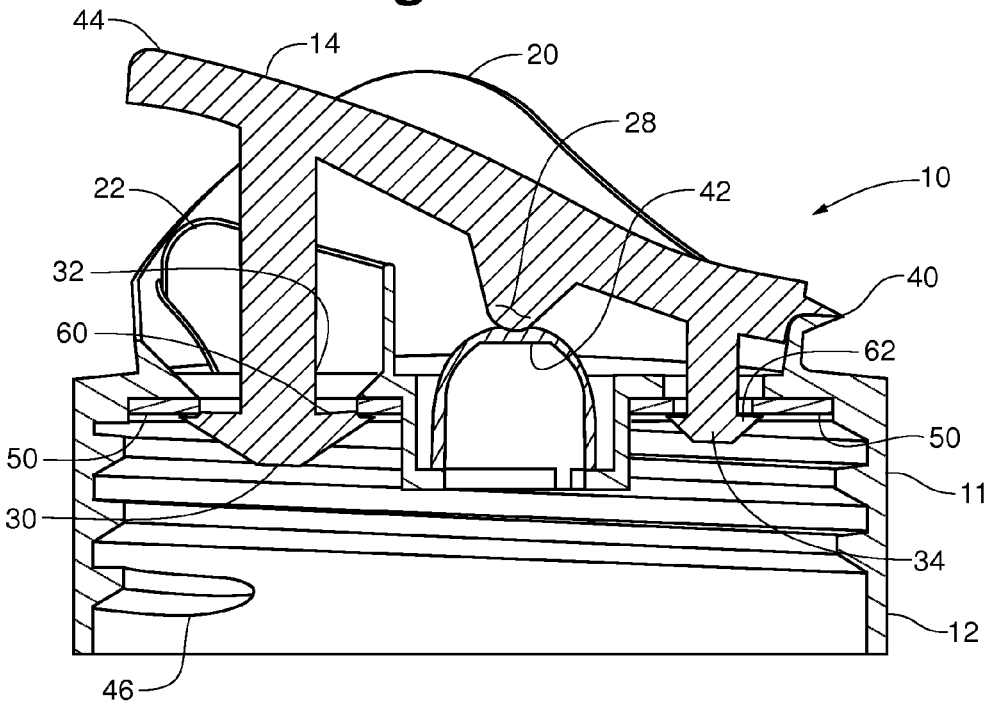
FIG. 3B is a side cutaway view of a dispenser assembly in a closed position in an embodiment of the present invention.

With reference to FIGS. 3A and 3B an upper elevated view of a dispenser assembly in a closed position in an embodiment of the present invention is shown. Upon lid 14 being rotated about axis 40 to adjoin lid 14 with body 12. As shown in FIG. 3B, as lid 14 comes in contact with body 12, liquid seal 30 will penetrate nozzle opening 32 breaching seal sheet 50. Underside 60 of liquid seal 30 will engage seal sheet 50 thus preventing liquid from escaping a liquid container as long as the operator is not pressing upon lid 14. Further, upon rotating of lid 14 to engage body 12, air seal 34 will penetrate air port 24 breaching seal sheet 50 thus causing air-seal underside 62 to engage seal sheet 50 thus causing no air to enter a liquid dispensing container as long as an operator has not pressed upon lid 14. During normal operation, as long as an operator is not pressing upon lid 14, then lid housing mechanism is pressing outward on dome 42 which presses outward on actuator 28 thus pressing outward on lid 14. This keeps lid 14 pressed outward and thus liquid seal 30 and air seal 34 are pressed upon seal sheet 50 preventing liquid from exiting a liquid container and air from entering a container.

Figure 4:
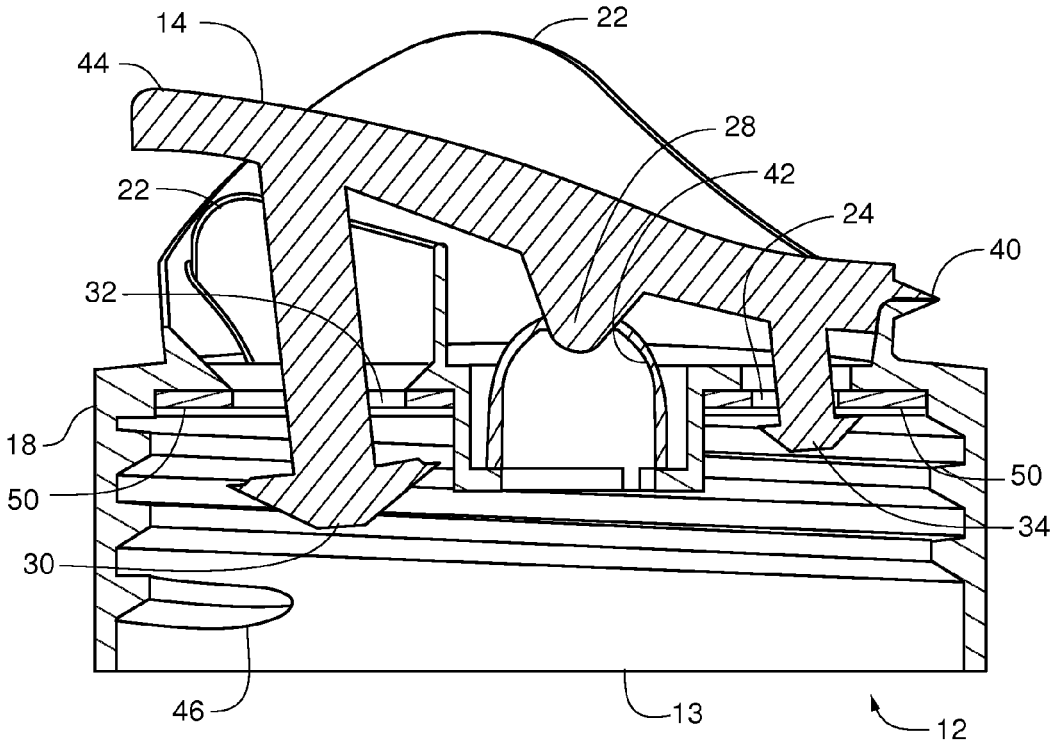
FIG. 4 is a side cutaway view of a dispenser assembly in a depressed position in an embodiment of the present invention.

With reference to FIG. 4, a side cutaway view of a dispenser assembly in a depressed position in an embodiment of the present invention is shown. When an operator depresses upon lid 14 several events happen almost simultaneously. Actuator 28 depresses upon dome 42 and thus stem 26 will continually press outward against the operator's pressure to try to move lid 14 into a closed assembly as shown in FIGS. 3A and 3B. Further, liquid seal 30 and air seal 34 are pressed inward of body 12 toward opening 13, thus breaking a seal between liquid seal 30 and air seal 34 from seal sheet 50. By performing this operation, the fluid in a fluid container is allowed to pass through nozzle opening 32 and air is allowed to pass into the fluid container through air port 24. This action allows fluid to pass outward of the fluid container and air to enter the fluid container thus balancing the pressure in the fluid container. When the operator has emptied enough fluid from the fluid container, the operator would simply release pressure on lid 14, thus causing liquid seal 30 and air seal 34 to reengage seal sheet 50 thus not allowing fluid to flow out of the fluid container nor air to flow into the fluid container. It should be noted nozzle 22 also acts as a stopper for lid 14. Thus nozzle 22 prevents lid 14 to move any further toward a liquid dispenser when an operator pressed inward on lid 14. This acts to create a "pouring" opening from nozzle opening 32. If nozzle 22 were not there it would be possible for a user to press inwards on lid 14 far enough to completely close nozzle opening 32. Thus it is preferable to have nozzle 22, but not necessary as fluid dispenser 10 could operate with or without nozzle 22.

Figure 5:
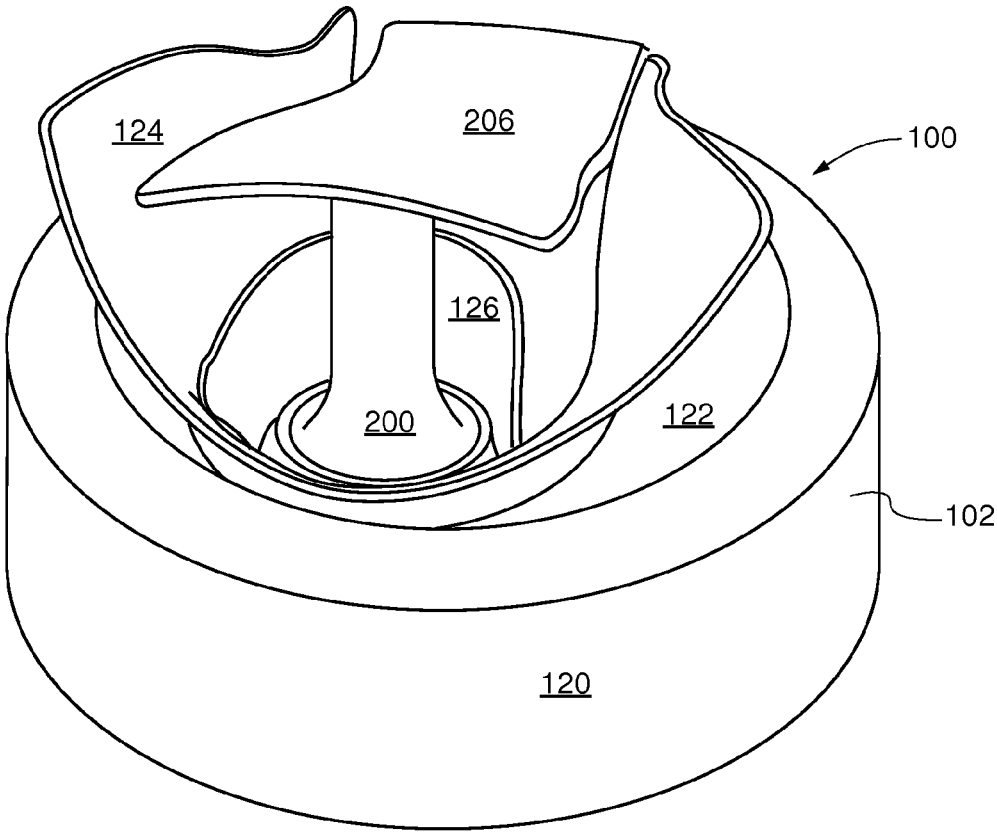
FIG. 5 is an isometric view of a dispenser assembly in an embodiment of the present invention.

With reference to FIG. 5, an isometric view of a dispenser assembly in an embodiment of the present invention is shown. An alternative embodiment of the present invention broadly discloses a dispenser 100, similar to dispenser 10 discussed above, which can be a cap 102, having body 120, top portion 122, flaring chute 124 and nozzle 126 or piece to be molded onto a container for dispensing liquids. Dispenser 100 can be similar to a vented valve type discussed above; the dispenser has a first opening 106 to allow liquid to exit the container and a second opening 104 to allow air to flow into a container. Allowing air to flow into the container creates substantially equal pressure on the inside and the outside of the container so a vacuum effect is not created.

Figure 6:
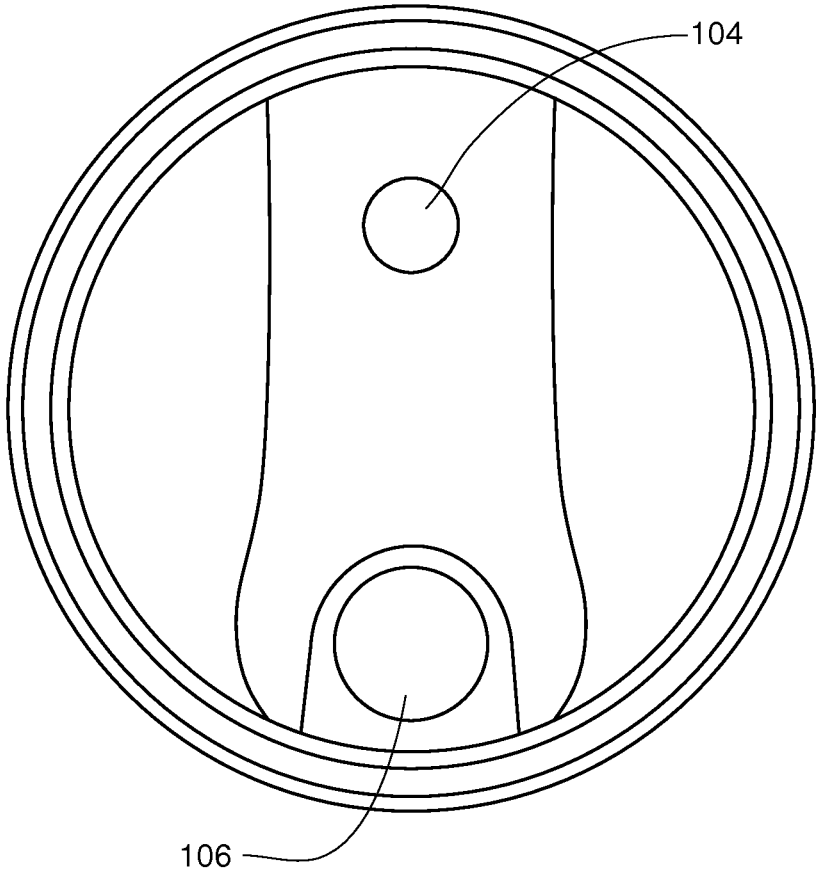
FIG. 6 is a view of the underside of a dispenser assembly in an embodiment of the present invention.
Figure 7:
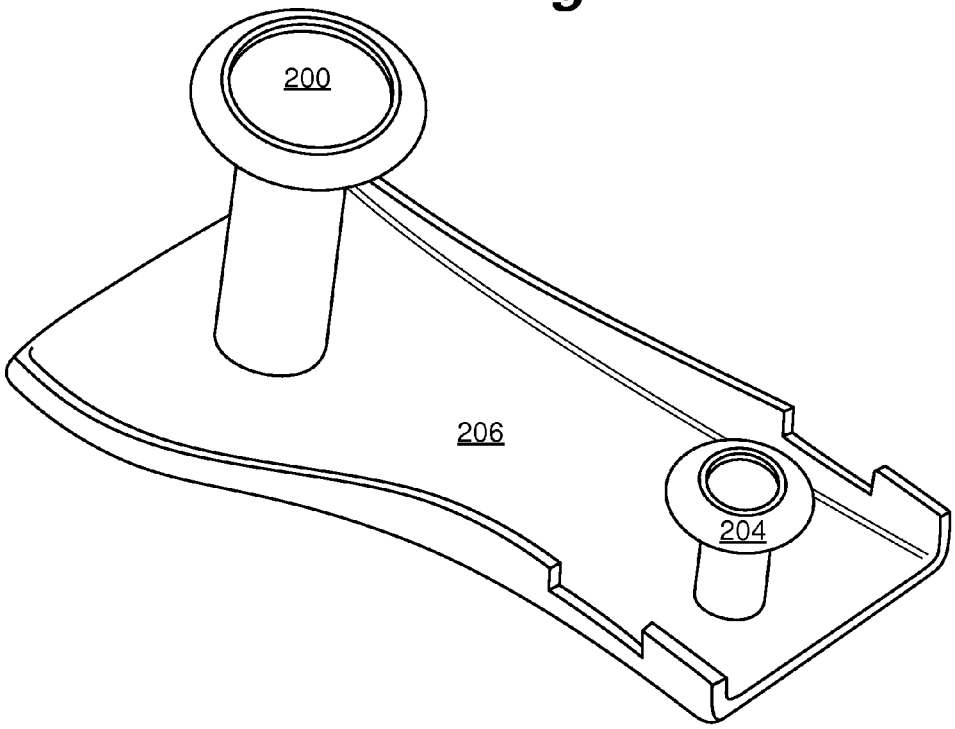
FIG. 7 is an isometric view of the underside of a lid in an embodiment of the present invention.

In the past, vented valves have had one opening which attempt to allow air to simultaneously flow into the container while allowing liquid to also flow out. Embodiments of the present invention disclose a vented valve dispenser for a container as shown in FIG. 5. As can be seen in FIG. 5, vented valve 100 of the present invention has a closure 200 which can be located within a first opening 106. In line with first opening 106 is a second smaller opening, as shown in FIG. 6. Second smaller opening 104 can have a closure piece 204 (FIG. 7) which fits within second smaller opening 104. First larger opening 106 allows a liquid to flow out of the container; while second smaller opening 104 allows air to enter into the container. In one embodiment, closure 200 and closure piece 204 snap fit within first opening 106 and second opening 104 respectively to provide a positive seal with first opening 106 and second opening 104.

As shown in FIG. 5, the first and second closures 200 and 204 are disposed on a lever 206. This lever 206 is attached to the outside of the dispenser 100 so the wider ends of the closure pieces are within the container. The size of closure 200 ensures the fluids do not come out of dispenser 100. When dispenser 100 is in a closed position as shown in FIG. 5, closure 200 and closure piece 204 of seal dispenser 100 and the container is closed so no liquid can exit and no air can enter. When a user desires to open dispenser 100, the user engages lever 206 by pressing inward towards the container. The closure pieces 200 and 204 are moved away from openings 104 and 106 and into the container so liquid exits the container by flowing outwardly and around larger closure piece 200 and air enters into the container by flowing around smaller closure piece 204. Lever 206 may be coupled to dispenser 100 in any means so it is held in a closed position and only opens when a force is applied against it.

Thus, embodiments of the DISPENSER ASSEMBLY are disclosed. One skilled in the art will appreciate the present teachings can be practiced with embodiments other than those disclosed. The disclosed embodiments are presented for functions of illustration and not limitation, and the present teachings are limited only by the claims follow.

What is claimed is:

1. A dispenser for attachment to a liquid container comprising:

(a) a valve body of a generally hollow form having a liquid inlet port on one end of the valve body for coupling to the liquid container, the valve body further including an air vent opening and a liquid vent opening, the air vent opening and liquid vent opening located on an opposite side of the valve body from the inlet port;

(b) a lid, the lid and valve body formed of a single piece of material, the lid movable between a liquid blocking and a liquid dispensing position;

(c) a liquid seal coupled to the lid and positionable within the liquid vent opening and an air seal coupled to the lid and positionable within the air vent opening;

(d) a collapsible dome member coupled to the valve body adjacent to the lid, the collapsible dome member deformable between a compressed and an expanded state.

2. The dispenser of claim 1, wherein the dome member is made of a polymer.

3. The dispenser of claim 1, wherein the dispenser is injection molded of a rigid plastic selected from a group consisting of polypropylene, polyethylene, polycarbonate and blends thereof.

4. The dispenser of claim 1, further comprising a seal sheet located on an inside surface of the valve body adjacent the liquid vent.

5. The dispenser of claim 1 wherein the seal sheet is comprised of a polymer.

6. A dispenser, comprising:

(a) a generally cylindrical valve body having a liquid inlet end and an opposite end, the opposite end having a liquid outlet port and an air vent opening;

(b) a lid, the lid and valve body formed of a single piece of material, the lid movable between a liquid blocking and a liquid dispensing position;

(c) a liquid seal and an air seal, the liquid seal coupled to the lid and positionable within the liquid outlet port, the air seal coupled to the lid and positionable within an air vent opening; and (d) a collapsible dome member coupled to the valve body adjacent to the lid.

7. The dispenser of claim 6, wherein the liquid seal and the air seal move together to uncover the liquid outlet port and the air vent opening when the lid is depressed.

8. The dispenser of claim 6, further comprising a flaring chute proximate the liquid outlet port.

9. The dispenser of claim 6, further comprising a nozzle located adjacent to the liquid outlet port.

10. The dispenser of claim 6, wherein the valve body is coupleable to a liquid container by: gluing, rotating upon threads, snap coupling or heat welding.

11. A dispenser, comprising:

(a) a valve body having a liquid inlet port on one end of the valve body and an air vent opening and liquid vent opening located on an opposite side of the valve body;

(b) a lid hingedly attached to the valve body, the lid and valve body formed of a single piece of material, the lid movable between a liquid blocking and a liquid dispensing position;

(c) a liquid seal and an air seal coupled to the lid, the liquid seal positionable within the liquid vent opening and the air seal positionable within the air vent opening;

(d) a collapsible dome member coupled to the valve body adjacent to the lid, the collapsible dome member formed from a polymeric material and being deformable between a compressed and an expanded state.

12. The dispenser of claim 11 wherein the valve body and lid are integrally injection molded of a rigid plastic selected from a group consisting of polypropylene, polyethylene, polycarbonate and blends thereof.

13. The dispenser of claim 11, further comprising a flange member located adjacent to the liquid vent opening.

14. The dispenser of claim 11, further comprising a seal sheet located on an inside surface of the valve body adjacent the liquid vent opening.

15. The dispenser of claim 14, wherein the seal sheet is comprised of a polymer.

16. The dispenser of claim 15, wherein the seal sheet is formed from a thermoplastic elastomer.

17. The dispenser of claim 11, wherein the collapsible dome member is formed from a thermoplastic elastomer.

18. The dispenser of claim 1, wherein the collapsible dome member is formed from a thermoplastic elastomer.

19. The dispenser of claim 18, wherein the lid is hingedly attached to the valve body.

20. The dispenser of claim 19, wherein the liquid seal and lid are formed from single piece of material.

* * * * *